US005632612A

United States Patent [19]

Shaffer

[11] Patent Number: 5,632,612

[45] Date of Patent: May 27, 1997

[54] SCROLL COMPRESSOR HAVING A TIP SEAL

[75] Inventor: Robert Shaffer, Hamilton, Ohio

[73] Assignees: Air Squared, Inc., Hamilton, Ohio; Puritan-Bekkett, Corp., St. Charles, Mo.

[21] Appl. No.: 557,407

[22] Filed: Nov. 13, 1995

Related U.S. Application Data

[63] Continuation-in-part of Ser. No. 223,039, Apr. 5, 1994, Pat. No. 5,466,134.

[51] Int. Cl.[6] ..... F04C 18/04; F04C 27/00

[52] U.S. Cl. ..... 418/55.4; 418/142

[58] Field of Search ..... 418/55.3, 55.4, 418/142; 277/204

[56] References Cited

U.S. PATENT DOCUMENTS

| | | | |
|---|---|---|---|
| 3,827,701 | 8/1974 | Sakamaki | 418/142 |
| 4,065,279 | 12/1977 | McCullough | 418/55.4 |
| 4,730,375 | 3/1988 | Nakamura et al. | 418/55.4 |
| 5,232,355 | 8/1993 | Fujii et al. | 418/55.4 |

FOREIGN PATENT DOCUMENTS

| | | | |
|---|---|---|---|
| 5551982 | 4/1980 | Japan | 418/55.3 |
| 2-9976 | 1/1990 | Japan | 418/55.4 |

*Primary Examiner*—John J. Vrablik
*Attorney, Agent, or Firm*—Paul M. Denk

[57] ABSTRACT

A scroll compressor includes a fixed scroll member and an orbiting scroll. The orbiting scroll member is operatively connected to a motor to be driven in an orbiting motion by the motor. The scroll members each include a plate having an inboard surface and an outboard surface. A spiral involute or wrap is formed on the inboard surface of each scroll member plate. The involutes mate to define suction zones at outer ends of the involutes and fluid pockets. The fixed scroll member defines a fluid outlet at the center of the involutes and two inlets positioned proximate the suction zones. At least two idler crank assemblies are provided to maintain the phase relationship and running clearance between the scroll members. The idler crank assemblies each include two operatively connected cranks, one being in the fixed scroll and one being in the orbiting scroll. The fixed scroll crank is externally accessible so that its rotational motion may be harnessed to drive a fan or another compressor stage, for example. Ribs are formed on the surfaces of the plates to facilitate heat dissipation and to make the scroll members more rigid. The involutes are provided with seals which seal against the plate of the opposing scroll member to seal the fluid pockets against leakage. A method is also provided for varying the displacement of the scroll compressor without the need to adjust the counterweight, idler cranks or the housing.

3 Claims, 8 Drawing Sheets

SCROLL COMPRESSOR HAVING A TIP SEAL

CROSS REFERENCE TO RELATED APPLICATION

This invention is related to and comprises a continuation-in-part of the patent application having Ser. No. 08/223,039, filed Apr. 5, 1994, now U.S. Pat. No. 5,466,134, and which patent is owned by common assignees, the contents of said application being incorporated herein by reference.

BACKGROUND OF THE INVENTION

This invention relates to scroll compressors, and in particular to a scroll compressor with increased efficiencies. Although compressors are used for example, this invention applies to scroll vacuum pumps and air motors equally.

Scroll compressors are often used in equipment such as oxygen concentrators and refrigerators. Scroll compressors are preferred for such applications because they tend to be quieter in operation than reciprocating compressors. Scroll compressors include two involutes or wraps which are meshed and define suction areas or zones at their outer edges. Fluid voids are defined by the two involutes between their points of contact. One involute is fixed and the other is orbited, by an electric motor, for example. The orbiting motion of the orbiting involute causes the fluid voids to move toward the center of the involutes and become smaller to compress the fluid contained therein. The outlet is at the center of the scroll and the compressed fluid is released at that point.

The involutes are maintained in a specific phase relationship. For the compressor to operate properly, the phase relationship between the two involutes must be maintained. Typically, oldham couplings have been used to maintain the phase relationship. However, these couplings require lubrication. If there is insufficient lubrication in the coupling, the compressor will fail. Others have used idler cranks to maintain the phase relationship. Such systems are shown, for example, in U.S. Pat. Nos. 4,192,152 to Armstrong et al and 5,154,592 to Ohtani et al. Both these compressors place idler cranks at the periphery of the scrolls. The idler cranks maintain the two scrolls in the proper phase relationship. However, they do not allow for harnessing of the rotary motion of the crank. This motion could be used to drive other items, such as fans.

The running clearance between the fixed and orbiting scroll members must be precisely controlled for the compressor to operate properly. Hard machined stops in either the housing or fixed scroll have been used to control the running clearance. However, a hard stop is not suitable for non-lubricated compressors. The running clearance has also been controlled using precision angular contacts or spherical roller bearings. U.S. Pat. No. 4,472,120, to McCullough, is one example of a compressor using spherical roller bearings. These bearings, however, are very expensive.

The running clearance between the fixed and orbiting scroll members creates a "blow hole" formed by the space between the tip of one involute and the plate of the opposing scroll member. This "blow hole" creates leaks in the fluid pockets which decreases the compressors performance. It is thus important that the seal between a wrap tip and the base of its opposing scroll be maintained as tight as possible. Maintaining the running clearance between the wrap tip and the opposing scroll base is complicated by the heat generated during operation of the compressor. Heat generation is not constant along the length of the scroll. More heat is generated at the center of the scroll, near the outlet, than at the beginning of the scrolls, near the inlet or suction areas. Some compressors have used compliance seals to maintain the blow hole closed while at the same time allowing for expansion of the involute along its length. Other compressors, such as the Ohtani et al compressor, do not use compliance seals. Rather, they change the height of the scroll along its length to accommodate the expansion of the scroll during operation. This of course will not maintain the blow hole closed at all times thus adversely affecting the compressor's performance. To avoid the use of compliance seals, a great deal of precision must be incorporated into the manufacture of the components parts. It becomes necessary to precisely maintain the relationship of the compressor housing with the fixed scroll and the central bearing within the housing. The central drive bearing in the orbiting scroll must also be precisely located. All this precision greatly increases the cost of the compressor.

Heat generation can, of course, be minimized by efficient heat dissipation. Ribs have been used to dissipate heat and to strengthen the scrolls. Typically, these ribs extend radially along an outboard surface of the scrolls. The ribs also serve to make the scrolls rigid to minimize deflection and distortion. Rigid scrolls aid in optimizing scroll performance. The position and formation of the ribs can be improved upon to both strengthen the scrolls and to improve heat dissipation.

It is often desirable to vary the displacement of a scroll compressor by a relatively small mount to allow for customer variations or motor frequency variation of 50 or 60 Hz, for example. In the past, this has been done in one of two ways. One method of varying the compressor displacement was to vary the height of the scroll involute. However, varying the height of the scroll involute requires changes to the idler cranks, counterweights, and housing to accommodate the change in the mass of the orbiting scroll and the change in the involute height. The second method was to shorten the involute wraps. This will reduce the compressor displacement without having to change the idler cranks and housing, however, the orbiting scroll mass is still changed and the counterweights must be adjusted accordingly. Also, shortening the involute wraps will effect compressor efficiency.

SUMMARY OF THE INVENTION

One object of the present invention is to provide an improved scroll compressor having a high level of performance.

A second object is to provide such a compressor in which idler cranks maintain the phase relationship between the fixed and orbiting scrolls and do not require lubrication.

A third object is to provide such a compressor in which idler cranks may be harnessed to drive other items, such as fans.

A fourth object is to provide such a compressor in which the running clearance between the fixed and orbiting scrolls is maintained without requiring extreme precision in the manufacture of the parts.

A fifth object is to provide such a compressor in which ribs easily and quickly dissipate heat produced during operation of the compressor.

A sixth object is to provide such a compressor in which the scrolls resist deflection and/or distortion.

A seventh object is to provide such a compressor in which the fluid intake is increased so that the same compressor can process greater amounts of fluid in a given time period.

An eighth object is to provide such a compressor which will operate efficiently and quietly.

A ninth object is to provide such a compressor which is of durable construction.

A tenth object is to provide a scroll compressor in which the compressor displacement may easily changed by small amounts.

An eleventh object is to provide a scroll compressor which has an improved tip seal.

These and other objects will become apparent to those skilled in the art in light of the following description and accompanying drawings.

In accordance with the invention, generally stated, a scroll compressor of the present invention includes a motor housed in a motor shell and a compressor housing which contains an orbiting scroll and a fixed scroll. The motor includes a motor shaft extending axially from the motor shell into the compressor housing. The compressor housing is secured to the motor shell and includes a circumferential side wall and a bottom. The bottom defines a boss through which the motor shaft is rotatably journaled. An eccentric is mounted on the motor shaft within the housing and the orbiting scroll member is mounted on the eccentric to be orbitally driven by the motor shaft when the motor shaft rotates.

The fixed and orbiting scroll members each include a plate having an inboard surface and an outboard surface. An involute extends from the inboard surface of each plate. The fixed scroll plate also defines an inlet and an outlet. The two involutes mesh with each other and define suction zones at outer ends of the involutes and fluid pockets. The fluid pockets are reduced in size as the scroll compressor is operated to compress a fluid. The outlet is located at the end or center of the involute. The inlet is located at the outside of the involutes. Preferably there are two inlets, both of which are located near a suction zone.

At least two idler crank assemblies extend between the fixed and orbiting scrolls to maintain the phase relationship and running clearance between the two scroll members. The idler crank assemblies are preferably positioned near the periphery of the scroll members. Each idler crank assembly includes two identical idler cranks received in bores formed in the scroll member plates. The cranks are operatively connected so that one crank orbits relative to the other when the scroll compressor is operated. Each crank includes an inboard and outboard bearing through which a crank shaft is journaled. Preferably, the inboard bearing is a thrust load supporting bearing and the outboard bearing is a radial load supporting bearing. The bores have shoulders formed therein adjacent inboard surfaces of the scroll members. The crank shaft includes a head at the inboard side of the idler crank and a threaded end at the outboard side of the crank. The head is larger than the diameter of the hole defined by the shoulder. A bearing nut, having a diameter larger than the bearing opening, is received on the threaded end of the shaft to hold the crank shaft in the bearings. A plate or disk is positioned between the crank shafts of each idler crank. The crank shaft of the fixed scroll is fixed to the center of the plate and the crank shaft of the orbiting scroll is fixed to the disk near its periphery. This enables the crank of the orbiting scroll to orbit around the crank of the fixed scroll. Preferably, the bearing bore of the fixed scroll member is a through bore, making the threaded end of the crank shaft externally accessibly. This allows for a device such as a fan blade or another compressor stage to be added to the scroll compressor which can then be driven by the idler crank assembly.

Preferably the two bearings of each idler crank are spaced apart by a shim. Further, the bearings are pre-loaded with a spring means .which is positioned between the crank shaft head and the inboard bearing. The spring means is preferably a wave washer. The crank assembly shims and nuts, in conjunction with the wave washer maintain the running clearance between the scroll members. The bearing nut is adjustable, and the clearance can therefore be adjusted by tightening or loosening the nut.

A groove is defined in the tips of the involutes. A compliant seal is held in the groove and is sized to extend slightly beyond the groove. The seal extends between the tip of one involute and the plate of the opposing scroll member to seal any "blow holes". The groove is formed to be relatively wide. Preferably, the wall of the groove has a width which is 25% or less than the depth of the groove.

Ribs are formed on the surfaces of the scroll members to strengthening the scroll members and to facilitate heat dissipation. The fixed scroll member includes ribs formed on the outboard surface which extend tangentially, rather than radially, from its bearing boss. The scroll members have a generally triangular shape defined by three projections where the idler crank assemblies are located. The fixed scroll member also includes ribs which extend along the edges of the triangular projections. Another rib extends around an outer portion of the involute, preferably around about 180° of the involute.

A series of ribs are also formed on the outboard surface of the fixed scroll member. Again, these ribs do not extend radially from the center of the scroll. Rather, they are formed to direct the air flow across the scroll member from one edge to another. Preferably, the ribs have an axis of symmetry which extends across the scroll member from the top thereof to its bottom.

In accordance with another aspect of the invention, an alternative seal is provided for the tip of the involute. The seal includes a seal body which is received in the groove formed in the tip of one of the involutes, preferably in both of the involutes. The seal body defines a second groove which receives a soft cord, analogous to an O-ring. The groove in the seal body is positioned so that the cord contacts a wall of the involute tip groove to create a positive seal with the tip groove.

In another aspect, a method is provided for varying the displacement of the scroll compressor without the need to adjust the counterweight, idler cranks or the housing. The method includes relieving the involute of the fixed scroll adjacent the suction zones of the compressor. Two identical relieved areas are formed which are opposite each other. Since the relieved area is in the fixed scroll, the orbiting mass does not change and the counterweight need not be adjusted. To compensate for a change in the pressure ratio, the fixed involute may also be relieved near the outlet, again in two identical areas.

DESCRIPTION OF THE PREFERRED EMBODIMENT

Figure 1:
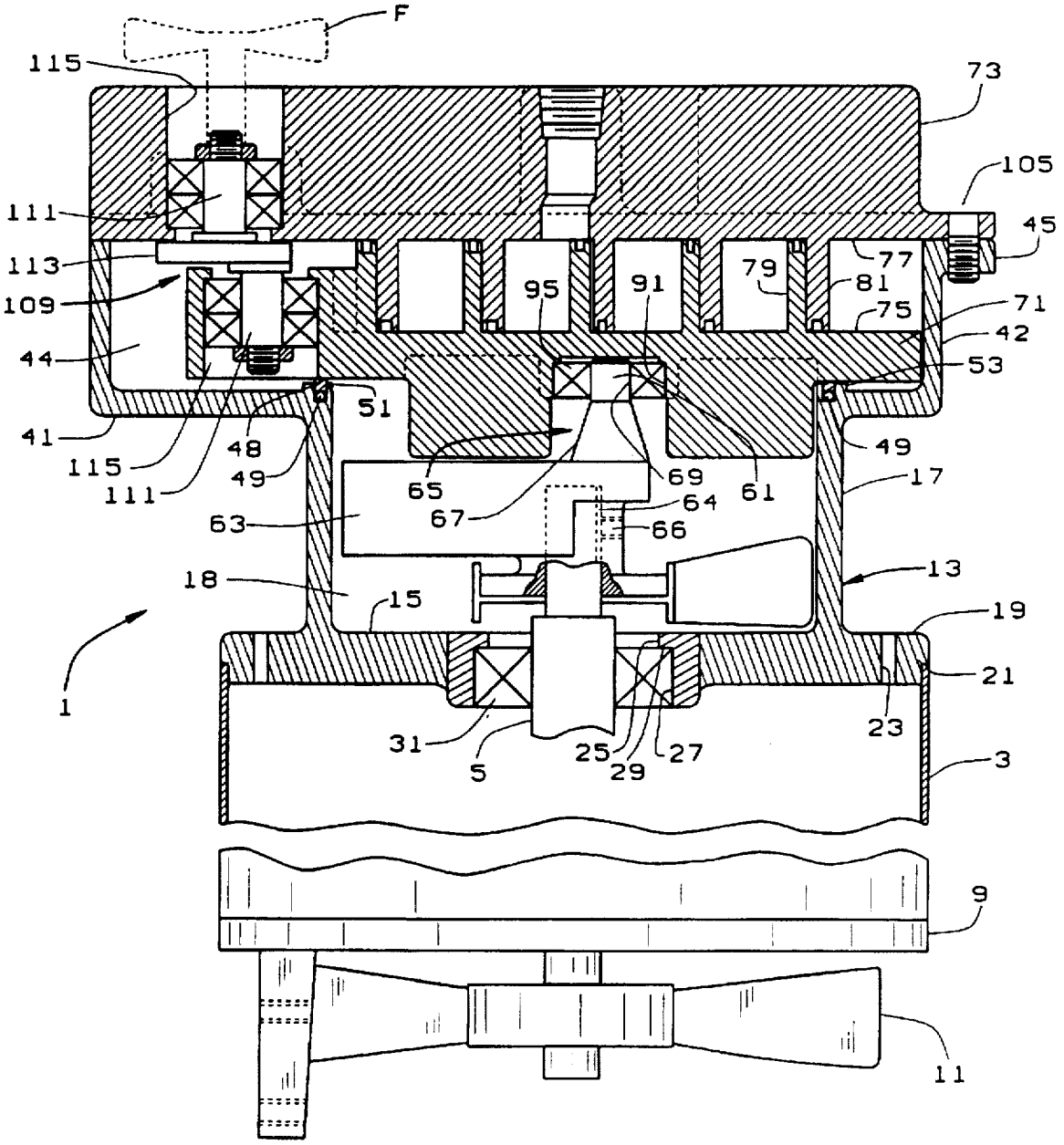
FIG. 1 is a cross-sectional view of a scroll compressor of the present invention.

A scroll compressor 1 of the present invention is shown generally in FIG. 1. Compressor 1 includes a motor assembly having a motor shell 3 which houses a stator and rotor, as is known in the art. A rotor shaft 5 extends axially from the rotor. Shell 3 is closed at one end by an end-shield 9. Shaft 5 may extend through end-shield 9 to receive a part 11 such as a fan blade.

The other end of shell 3 is closed by a compressor housing 13. Housing 13 has a bottom 15 and a circumferential wall 17 which extends axially upwardly from bottom 15 to define a well 18. A circumferential flange 19 extends radially outwardly from wall 17. Flange 19 defines a shoulder 21 which sits on motor shell 3. Through bores 23 are formed on the flange to receive throughbolts to hold the housing to the motor assembly, as is known in the art.

Bottom 15 defines an opening 25 through which rotor shaft 5 extends. Opening 25 is counterbored as at 27 to define a shoulder 29. A bearing 31 is received in counterbore 27 and seats against shoulder 29. Shaft 5 is journaled for rotation in bearing 31 and extends into well 18. A plurality of openings 32 (FIGS. 2 and 3) are formed in well bottom 15. Openings 32 define a circle concentric about opening 25 and allow for air to circulate between the interiors of the scroll housing and the motor housing.

Figure 2:
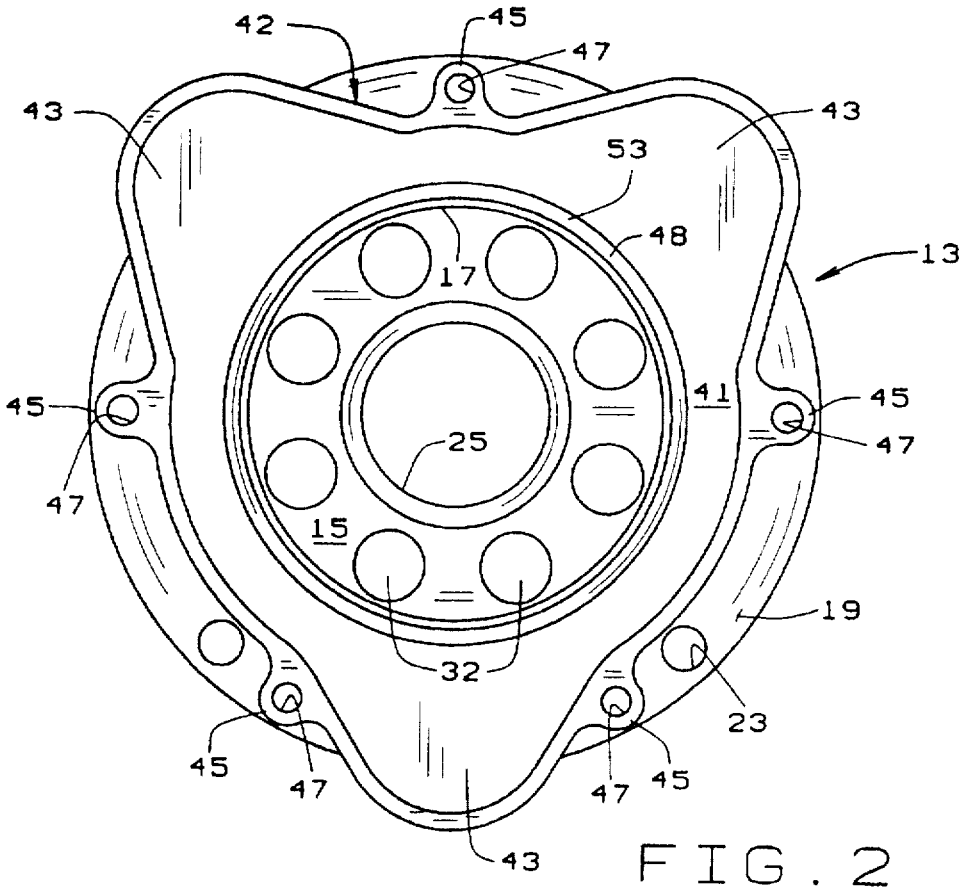
FIG. 2 is a top plan view a housing of the scroll compressor.
Figure 3:
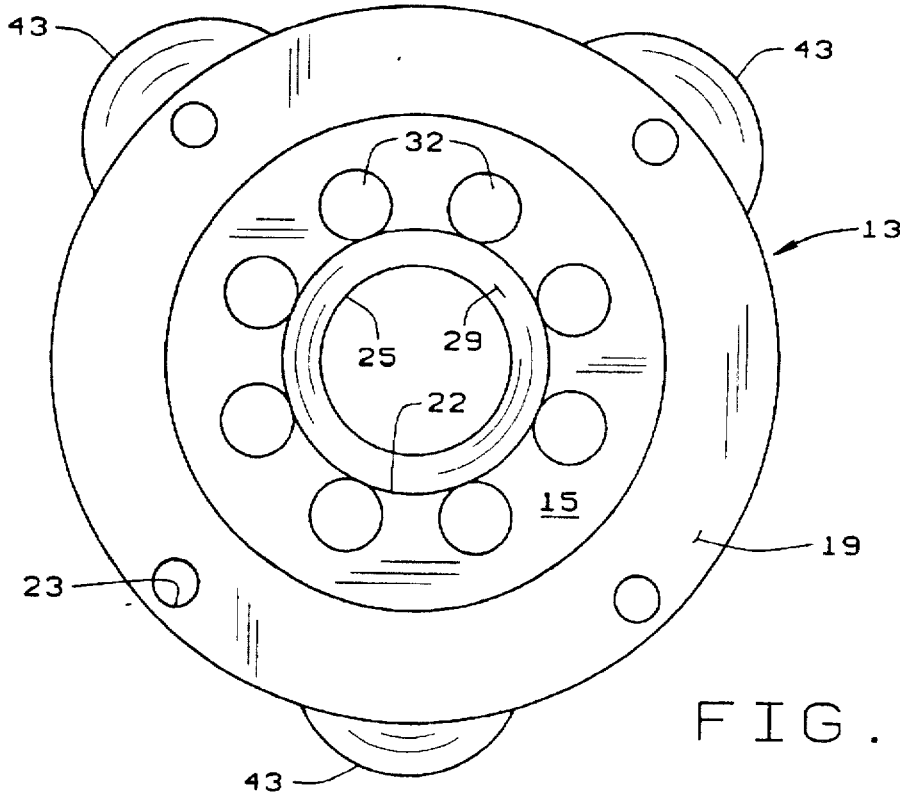
FIG. 3 is a bottom plan view of the housing.

At the top of well 18, with reference to FIG. 1, a second floor 41 extends radially outwardly of wall 17. A peripheral wall 42 extends axially upwardly from floor 41 and defines a second well 44. Floor 41 is generally triangular in shape, as seen in FIGS. 2 and 3 and defines three rounded-off, generally triangular areas 43 which extend beyond bottom 19. Between areas 43, the wall 42 is generally arced, the arc defining a circle which is generally concentric with bottom 19. A plurality of ears 45 extend outwardly from the top of wall 42. There are preferably five such ears and each ear 45 defines a bolt hole 47. An upwardly facing groove 48 is formed at the top of wall 17. Groove 48 receives an O-ring 49 and an elastomeric seal 51 (FIG. 1). O-ring 49 sits in the bottom of groove 48 and seal 51 sits on top of O-ring 49. A downwardly sloping surface 53 is formed on the radially outer wall of groove 47 and leads down to floor 41.

An eccentric 61 and counterweight 63 are fixed to rotor shaft 5 inside of well 18. Eccentric 61 and counterweight 63 are preferably formed as one piece, but may be formed as two independent parts. The eccentric/counterweight assembly has a blind bore 64 formed in its bottom which receives shaft 5. A set screw 66 extends radially through a side of the eccentric/counterweight assembly and bears against shaft 5 to fix the assembly to shaft 5. The eccentric/counterweight assembly thus rotates with shaft 5. An arm 65 extends upwardly from eccentric 61. Arm 65 is radially offset from shaft 5 so that it will orbit around shaft 5 when shaft 5 is rotated. Arm 65 is preferably formed with a tapered base 67 having an upwardly extending cylinder 69.

Figure 13:
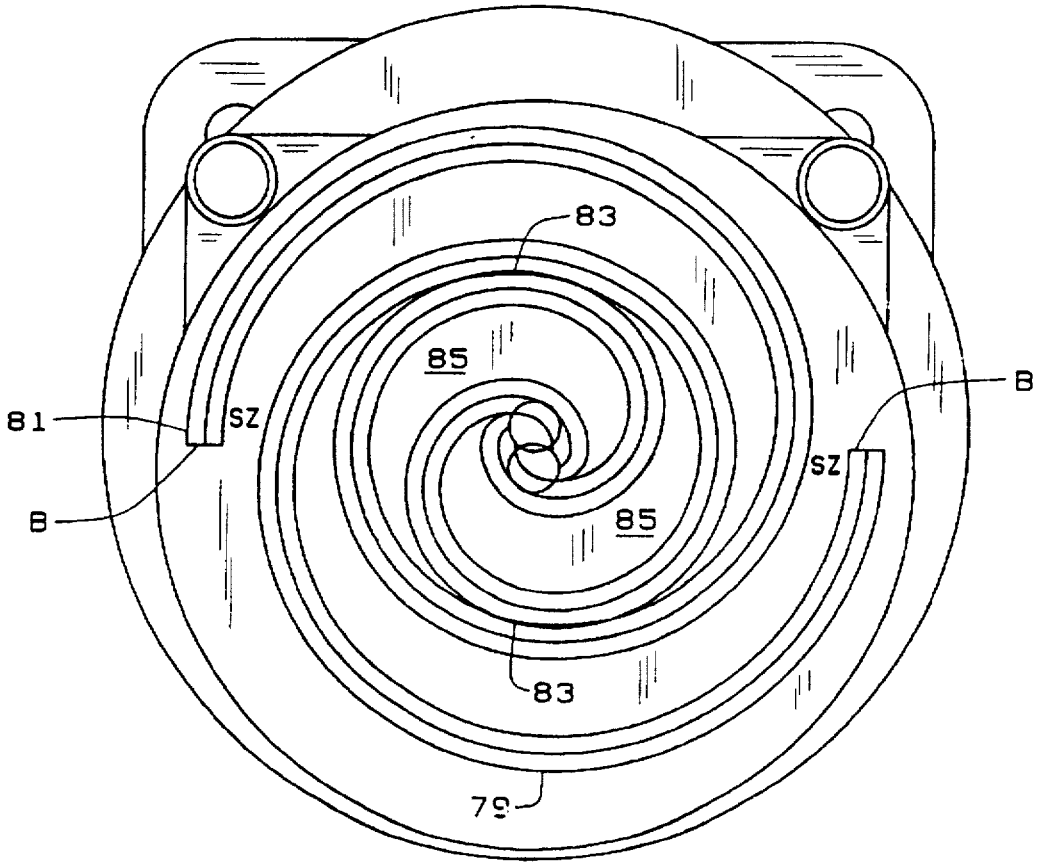
FIG. 13 is a plan view of the interaction between the involute spirals of the two scrolls.

An orbiting scroll member 71 (FIGS. 1 and 4–6) and a fixed scroll member 73 (FIGS. 1 and 8–10) are housed in upper well 44 of scroll housing 13. Each scroll member is generally circular with three equally spaced apart, generally triangular projections 74 and 76, respectively. Each scroll member includes a base 75 and 77, respectively, and an inboardly extending involute or wrap 79 and 81, respectively. The involutes may be integrally formed with the bases. Alternatively, and preferably, they are separate parts which are received in spiral grooves 80 (FIGS. 5 and 9) formed in the base. The involutes of the two scroll members, as seen in FIG. 13, are maintained 180° out of phase of each other and contact each other at points 83 to define fluid pockets 85.

Figure 11:
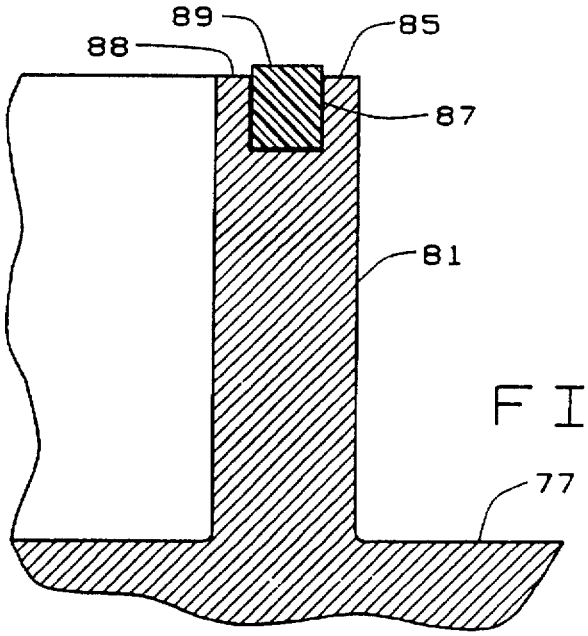
FIG. 11 is an enlarged cross-sectional view of a wrap of the scroll taken along line 11—11 of FIG. 10.

The wraps 79 and 81 are sized and supported so that the wrap of one scroll member extends nearly to the base of the opposing scroll member. As shown in FIG. 11, the wrap has a tip 85 defining a groove 87. A compliant seal 89 is received in groove 87 and seals any clearance or "blow hole" between one involute and its opposing base. The blow hole can be minimized by reducing the thickness of the groove wall 88. This can be accomplished either by making the wrap thinner or the seal wider. Preferably the wall 88 has a width of 25% or less than the depth of the groove 87. By reducing the thickness of wall 88, the running clearance between the wrap tip and its opposing base becomes less critical.

Scroll member 71 defines a bearing retaining bore 91 (FIGS. 1, 4 and 5) on an outboard surface of base 75. Bore 91 is generally concentric with the circular periphery of member 71. A shoulder 93 is formed in bore 91. A bearing 95 (FIG. 1) is received in bore 91 and seats against shoulder 93. The cylinder 69 of eccentric arm 65 is journaled in bearing 95 so that member 71 can rotate with respect to arm 65. The scroll member 71, as can be appreciated, is driven in an orbiting motion by eccentric 61 when the rotor shaft 5 is rotated by the motor. Counterweight 63 is sized to counter the weight of eccentric 61 and scroll member 71 so that the compressor 1 will be substantially balanced when it is operated. Scroll member 71 closes housing well 18. The outboard surface of base 75 seals against elastomeric seal 51.

Fixed scroll member 73 has a plurality of ears 101 (FIGS. 8–10) defining through bores 103. The scroll member ears 101 are aligned with the ears 45 of scroll housing 17. Bolts 105 (FIG. 1) are passed through the respective bores of the ears to secure the fixed scroll member to housing 17. Fixed scroll member 73 defines two fluid inlets 105 and a fluid outlet 107. Inlets 105 are positioned to align generally with the beginning B of the involutes (the suction zones SZ) (FIG. 13) so that fluid will directly enter the fluid pockets. By providing two inlets, instead of one, the fluid is provided a more direct route to the entrance or suction zone SZ of the compressor, enabling the compressor to process the fluid more efficiently. In other words, the fluid will enter the fluid pockets 85 more quickly because of the proximity to the suction zones SZ. If there were only one entrance, rather than the two provided, the fluid will have to work its way around the involute to the second suction zone. The outlet 107 is located at the center of the members, where the two involutes end. The use of two inlets, as opposed to one, also reduces the amount of preheating of the entering fluid due to travel around and within the scroll. By reducing the amount of preheating of the entering fluid, the amount of heat needed to be dissipated is reduced.

The two involutes, as seen in FIG. 13, are maintained 180° out of phase from each other. As is known, as the orbiting scroll is moved by the motor, fluid pockets 85 are moved from suction zone SZ toward the center. As fluid pockets 85 are moved toward the center of the scroll members, they are reduced in size to compress the fluid contained in the pocket. The fluid is then forced out of exit 107. A crank assembly 109 (FIG. 1) is provided to maintain the phase relationship between the scroll members. Crank assembly 109 includes two identical cranks 111 which are connected to opposite sides of a plate 113 off-set from each other.

Figure 12:
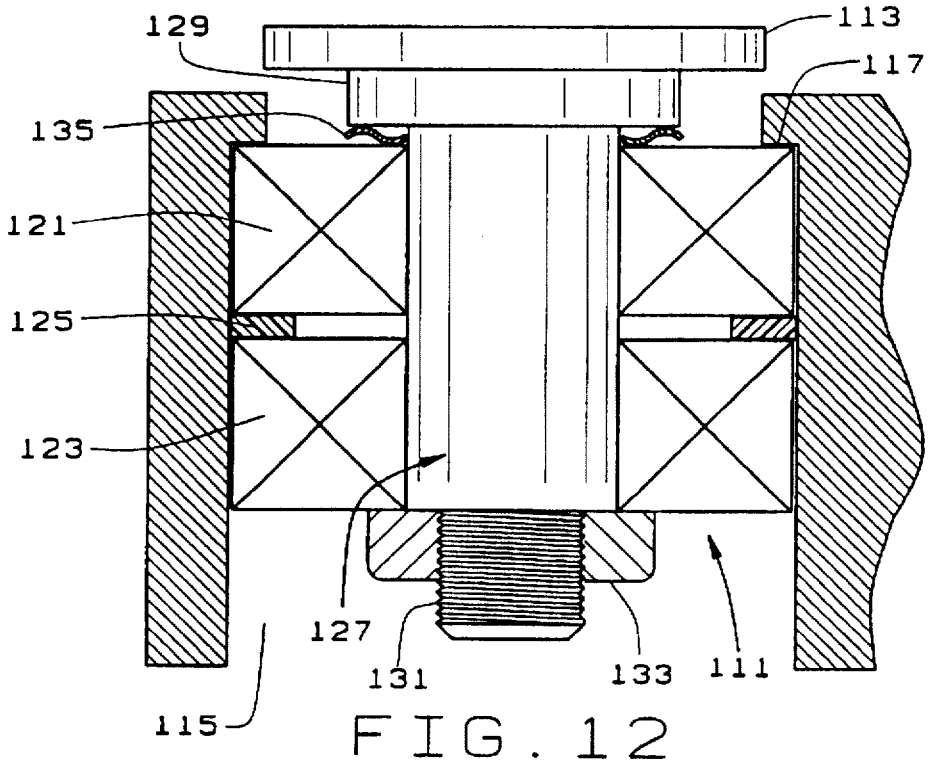
FIG. 12 is an enlarged view of a crank-shaft assembly.

Cranks 111 (shown in more detail in FIG. 12) are received in bores 115 defined in the scroll base extensions 43 and 74 respectively. A shoulder 117 is formed at the inboard surfaces of the scroll member bases. A radial load supporting bearing 121 is received in bore 115 seated against the shoulder 117. A thrust load support bearing 123 is received in bore 117 adjacent bearing 121. Beatings 121 and 123 are spaced apart by a thin shim 125. A pin 127 is journaled in bearings 121 and 123. Pin 127 has a cap 129 which is positioned at the inboard side of the scroll bases between shoulder 117 and a threaded end 131 which extends below bearing 123. A nut 133 is threaded onto end 131 to hold pin 127 in bearings 121 and 123. A wave washer 135 is positioned between pin cap 129 and bearing 121. Washer 135 pre-loads the idler crank assembly 109. Cap 129 is fixed to plate 113.

The crank of fixed scroll 73 is secured to plate 113 in the center thereof and the crank of orbiting scroll 71 is fixed to plate 113 near the periphery thereof, as seen in FIG. 1. The off-set between the two cranks is equal to the off-set between rotor shaft 5 and eccentric cylinder 69. Because the two cranks are fixed to the plate 113, the orbiting motion of scroll 71 is passed to its crank. The orbiting scroll crank will orbit around the fixed scroll crank, causing the fixed scroll crank to rotate in bearings 121 and 123. Bore 115 of fixed scroll 73 extends through the scroll member, making the crank externally accessible. The rotational motion of the fixed scroll crank can therefore be harnessed to drive a fan F (shown in phantom in FIG. 1), for example. The fixed scroll crank may also be used, for example, to drive additional scroll sets or stages to increase unit capacity or pressure, coolant pumps, super chargers, or expanders.

Since the idler cranks 111 are located in both the fixed and orbiting scroll, the bearing bores 115 can be located and machined in the same setup as the involute spiral. As the bores 115 can thus be formed at the same time, it is unnecessary to maintain extreme precision, thereby reducing manufacturing costs. In the preferred embodiment, it is also not necessary to maintain any special alignment between the fixed scroll and the housing, or between the housing and the orbiting scroll drive bearing. This also greatly reduces the cost of manufacturing.

Idler crank assembly 109 serves two functions. It works in conjunction with the eccentric 61 to maintain the phase relationship between the two scroll members. It also aids in maintaining the proper running clearance between the wrap tips and the bases of the scroll members. The spring or wave washer pre-loads the cranks to perform this function, aided by the shims 125.

The use of the double bearing in the idler crank assembly 109 allows off-the-shelf bearings to be used if the bearings are pre-loaded against each other. The pre-loading takes out all internal clearance in the bearings, eliminating the need for precision bearings, which are expensive. Bearing 123 is used for taking axial thrust loads and bearing 121 is used for taking radial loads. The housing around bearing 123 can be relieved to make assembly easier. Shim 125 is used to space the bearings apart and spring 129 is used to pre-load the bearings against each other. The nut 133 holds crank assemblies 111 together. Because the bearings are tightened against shoulder 117, the nut 133 can be used to adjust running clearance between the orbiting and fixed scrolls.

Figure 4:
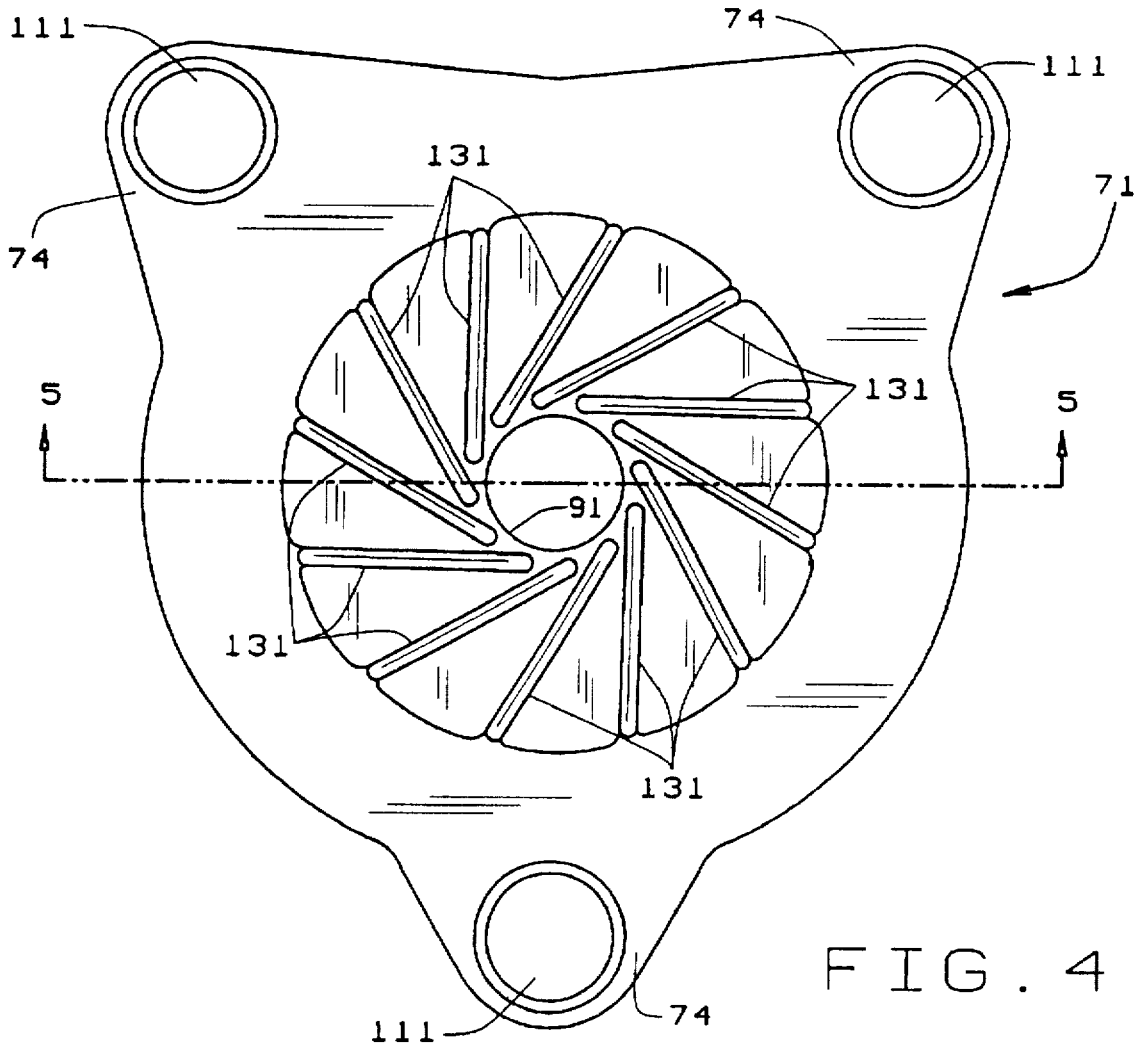
FIG. 4 is a plan view of an outboard surface of a orbiting scroll of the compressor.
Figure 5:
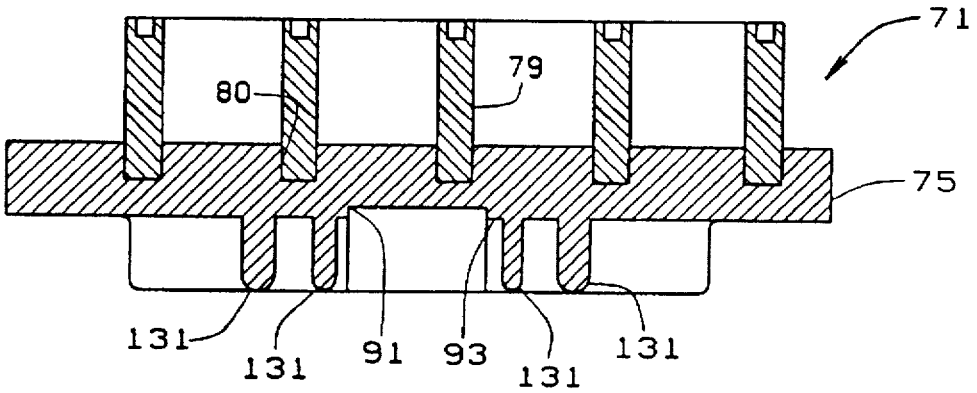
FIG. 5 is a cross-sectional view of the orbiting scroll taken along line 5—5 of FIG. 4.

To provide for heat dissipation and to stiffen the scroll members, the scroll members are provided with ribs. Turning to FIGS. 4 and 5, a plurality of ribs or vanes 131 extend from bore 91. Ribs 131 are formed on surface 75 to be at an angle other than 90° from hub or bore 91. Stated differently, they do not extend radially from hub 91 or extend along a diameter of hub 91. Preferably, ribs 131 extend generally tangentially from hub 91. As can be appreciated, ribs 131 are longer than they would be if the extended radially from hub 91. This increases the heat transfer area of the ribs, increasing the effectiveness of the cooling performed by the ribs during operation of the compressor 1. It also increases the stiffness of the scroll member, which also increases the efficiency of the compressor.

The rib configuration of FIG. 4 has several advantages. The ribs can extend above the central bearing hub area to improve the flow of cooling air at the center where the temperature is greatest. The ribs, being at an angle or arc, will enhance natural air moving capability of the orbiting scroll as it moves. This will be especially true if the scroll is rotating about its axis as is done in what is commonly referred to as a spinning scroll.

Since the involute does not cross radial lines at 90°, the ribs 131 are arranged to minimize the length of the rib between involute wraps. This optimizes stiffness of the scroll member 71. Optimum stiffness occurs when the ribs are arranged tangentially to the involute generating circle as is the case with ribs 131. Other rib configurations for surface 75, such as arcs of a circle, for example, can also be used to improve cooling and stiffness. For example, the ribs can be configured as an involute spiral instead of an are or straight rib. This configuration would allow the ribs to mesh with involute shaped ribs of the housing and in the same way compression takes place on the from of the scroll, the ribs can produce cooling air without the use of an axial fan.

Figure 6:
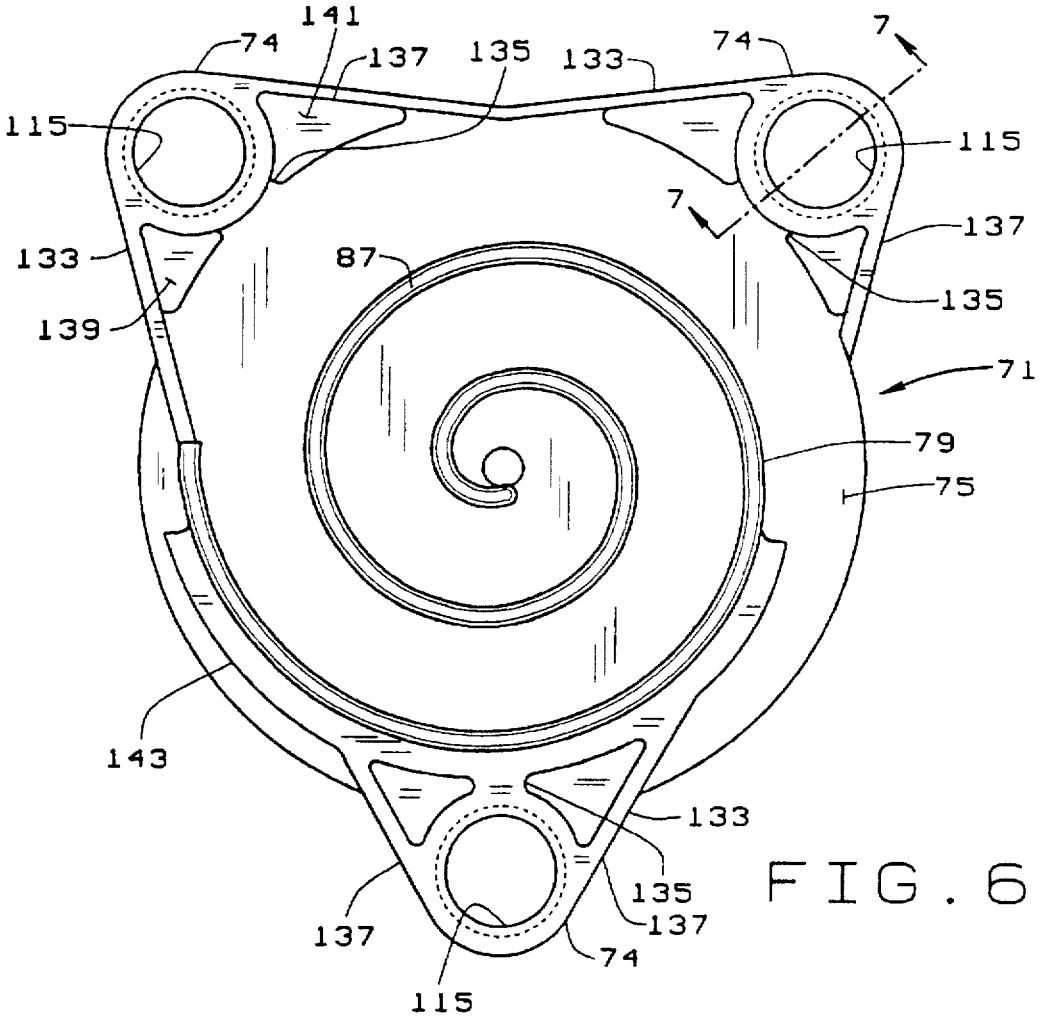
FIG. 6 is a plan view on an inboard surface of the orbiting scroll.
Figure 7:
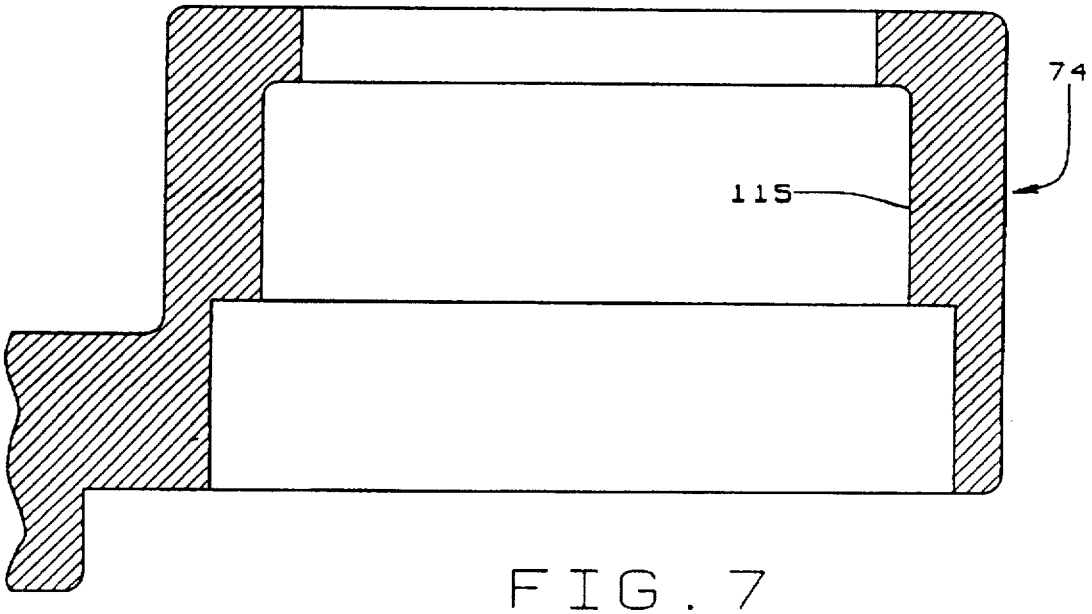
FIG. 7 is a cross-sectional view of a crank shaft bearing boss taken along line 7—7 of FIG. 6.

Turning to FIG. 6, further ribs are formed on the inboard surface of scroll member 71. Although ribs are shown only on the inboard surface of the orbiting scroll, they can also be formed on the inboard surface of the fixed scroll. Three ribs 133, 135, and 137 are associated with each bore 115 at projections 74. Ribs 133 and 137 extend along the edge of the projections 74 and are generally tangential to bore 115. The ribs 135 extend generally radially from an edge of the bore 115 toward the center of the scroll member. Ribs 133, 135 and 137 define two depressions 139 and 141. The ribs 133 and 137 of each projection are not generally perpendicular to each other. The two depressions are thus of differing sizes. An arcuate rib 143 is formed at the third projection between the depressions and wrap 79. Rib 143 preferably extends about 180° along wrap 79. Rib 143 stiffens the outer 180° of the involute, creating an enlarged involute. This enlarged involute can also act as a weight for balancing the scroll about its centerline.

Figure 8:
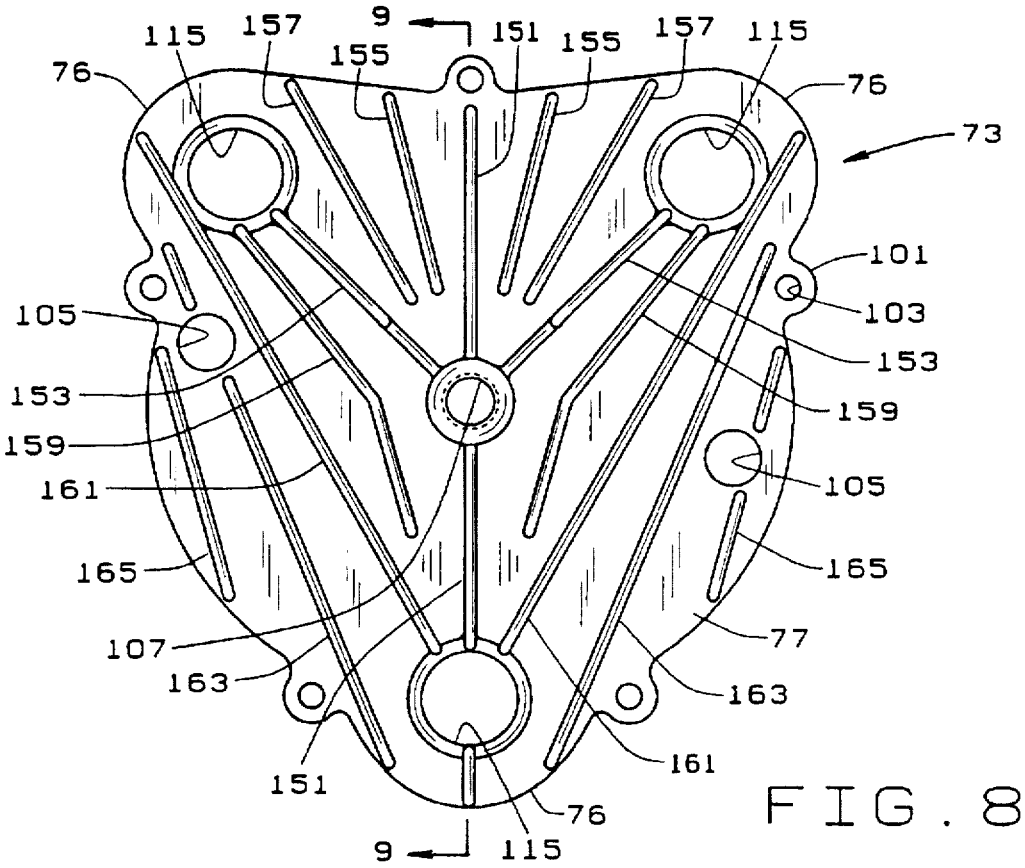
FIG. 8 is a plan view of an outboard surface of a fixed scroll of the compressor.
Figure 9:
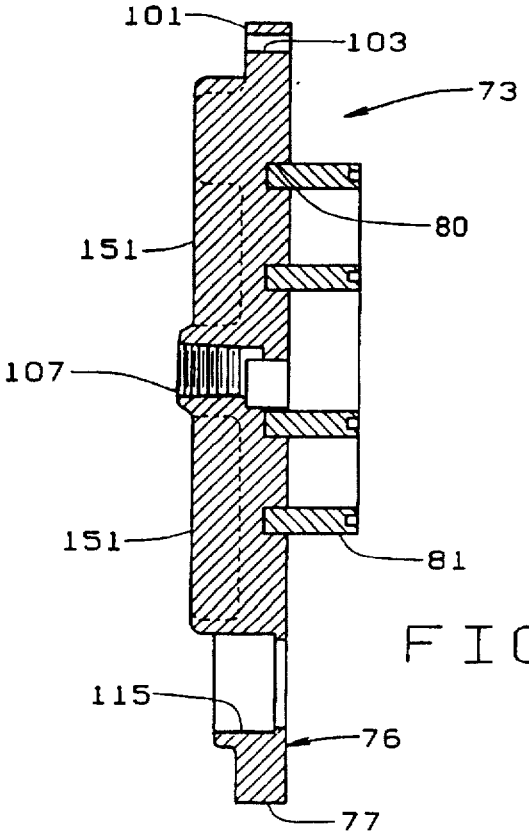
FIG. 9 is a cross-sectional view of the fixed scroll taken along line 9—9 of FIG. 8.
Figure 10:
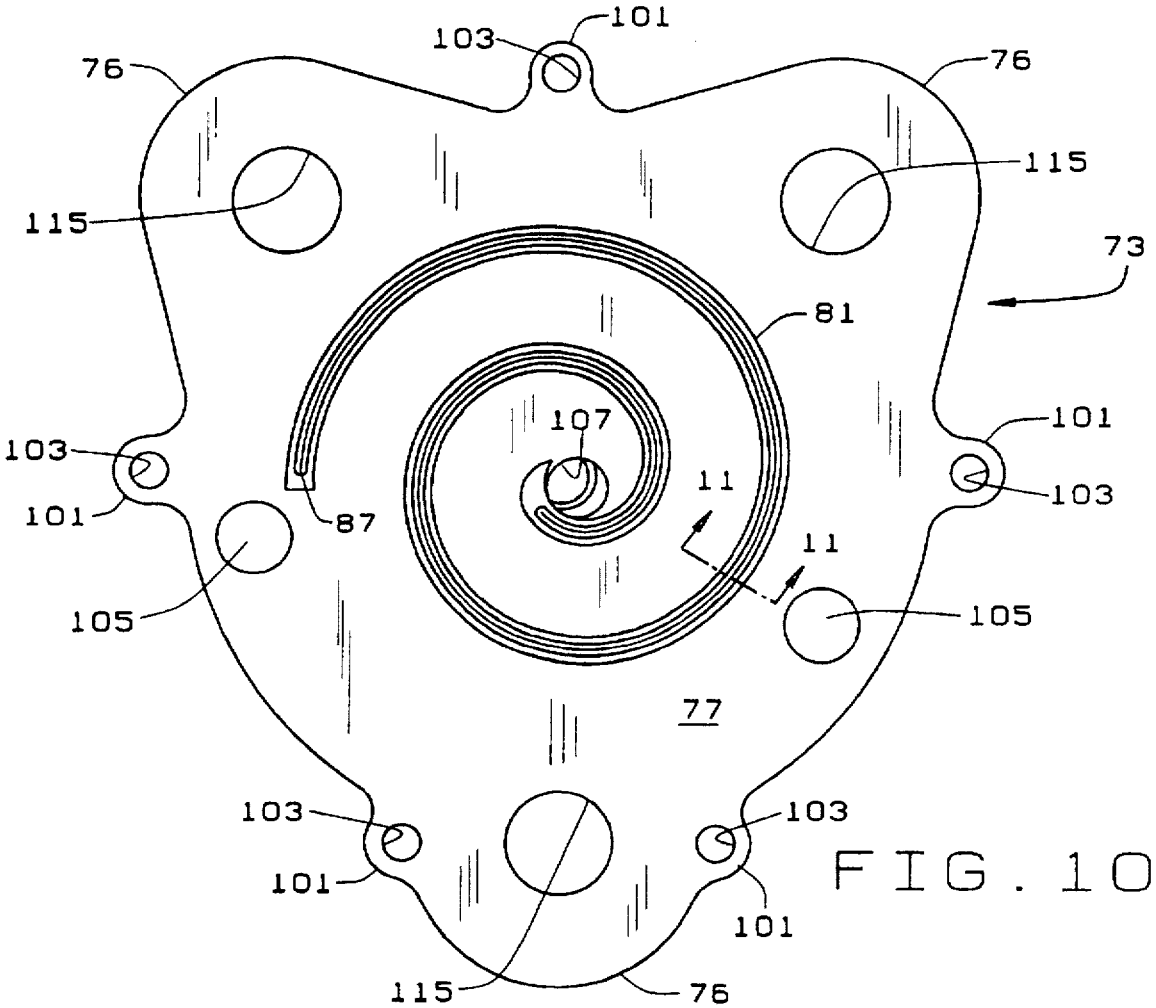
FIG. 10 is a plan view of an inboard surface of the fixed scroll.

Turning to FIG. 8, a plurality of ribs are formed on the outboard surface of scroll member 73. Because of the number of ribs formed on scroll member 73, the ribs will be described with respect to their orientation in the Figure. A central rib 151 extends from the bottom to the top of the member, passing through the center of the bottom bore 111 and through the fluid exit 107.

A pair of ribs 153 extend between fluid exit 107 and the two upper bores 111. Ribs 153, with the middle portion of rib 151 forms a Y-shape. The ribs 151 and 153, extending between the outlet boss and the idler bearing bosses provide for stiffening. These ribs are not of full height so that the flow of cooling air is not restricted.

Two ribs 155 and 157 are formed between rib 151 and rib 153, and extend nearly to the periphery of the scroll.

Below rib 153, a rib 159 extends from the top bore 111 generally toward fluid exit 107. When it is approximately even with the center of fluid exit 107, rib 159 bends generally downwardly toward the bottom bore 111.

An elongate rib 161 extends from bottom bore 111 towards the outer edge of top bore 111. Rib 161 extends tangentially along top bore 111 to a point near the edge of the scroll member.

A rib 163 extends from a point below and to the side of bottom bore 111 towards the ears 101 approximately two-thirds the way up the scroll member.

Lastly, a short rib 165 extends along the arcuate section of the scroll member defining a secant.

As can be seen from FIG. 8, the rib formation on either side of central rib 151 is identical. Rib 151 forms an axis of symmetry for the ribs. The ribs 155–165 augment the stiffness of the scroll member. They also maximize heat transfer without restricting air flow. The ribs are arranged primarily in the direction of the air flow. However, they are tilted slightly toward the center to improve stiffness.

As can be appreciated from the forgoing, an improved scroll compressor is described. The compressor's scroll members are stiffened by ribs which efficiently dissipate heat formed during the operation of the compressor. The double idler crank configuration accurately maintains the appropriate running clearance between the scroll members to substantially reduce "blow holes". The blow holes that do exist are substantially closed by the compliant seal. The double idler crank assembly also aids in maintaining the phase relationship between the involutes.

Figure 14:
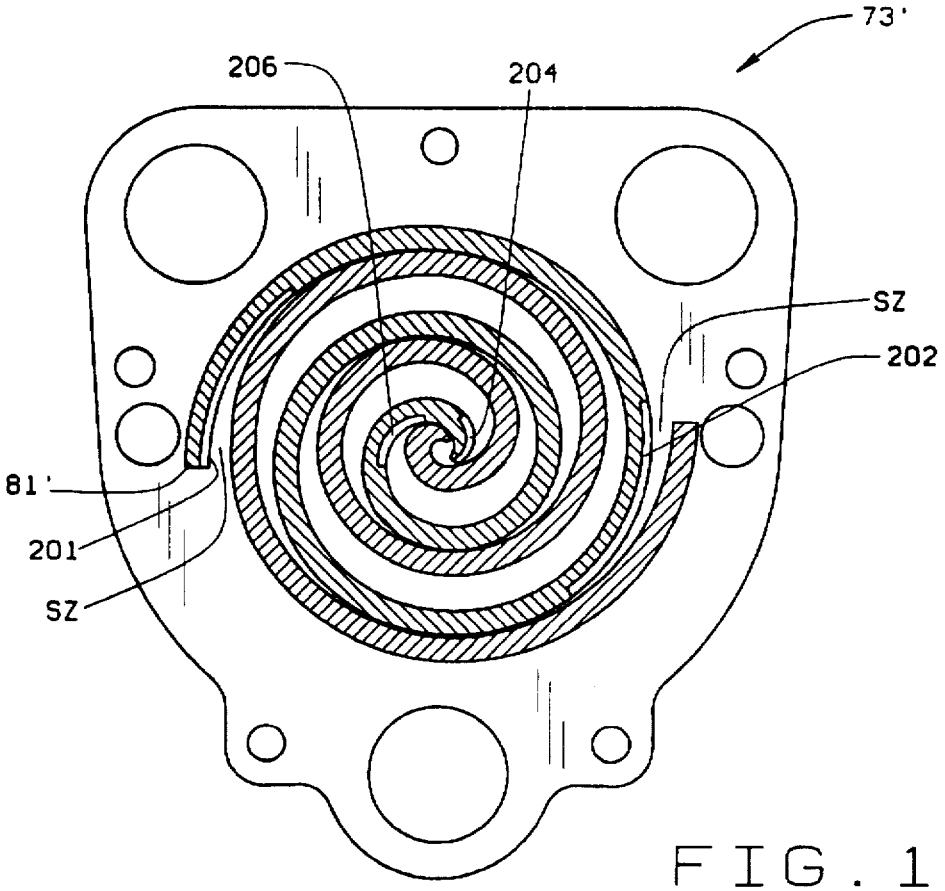
FIG. 14 is a plan view of an alternative embodiment of the fixed scroll, which will provide for slight varying of the displacement of the scroll compressor.

An alternative fixed scroll member 73' is shown in FIG. 14 which may be substituted for the fixed scroll member 73 in a scroll compressor. The fixed scroll member 73' has an involute or wrap 81' extending from an inboard surface of a base of the scroll member 73'. To vary the displacement of the scroll compressor, a portion of the outer wrap as been relieved, as at 201 and 202. The relieved areas 201 and 202 of the wrap 81' are, as can be seen, formed at the entrances to the suction zones SZ, and are identical to each other. Relieved the wrap 81' at the entrance to the suction zones SZ has the same effect as shortening the wrap. However, because the relieved areas are in the fixed scroll and not the orbiting scroll, the counterweights do not have to be adjusted.

Creating the relieved areas of the wrap of the fixed scroll member will create a change in the pressure ratio. To compensate for this change, the fixed scroll involute 81' may also be relieved, near the outlet, as at 204 and 206. The relieved areas 204 and 206 are in the fixed scroll, and thus do not require an adjustment in the counterweight. The relieved areas 204 and 206 are sized according to the size of the relieved areas 201 and 202 so that the pressure ratio of the scroll compressor would remain unchanged.

Figure 15:
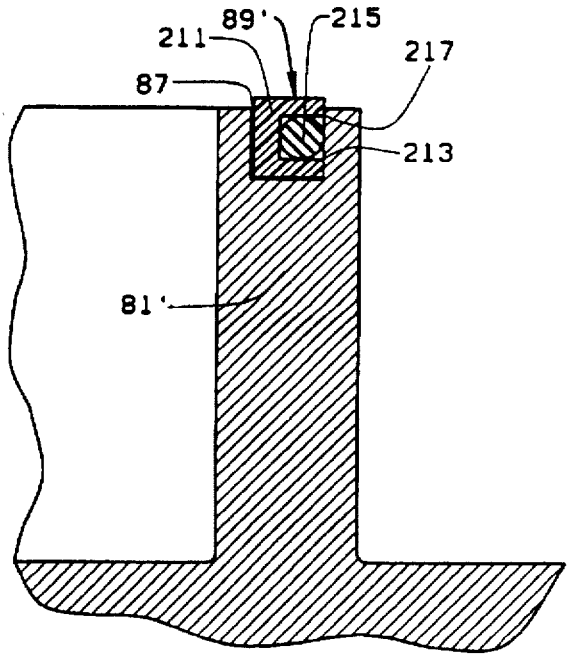
FIG. 15 is a cross-sectional view of an alternative embodiment of a tip seal for the involute wrap.

An alternate involute tip seal 89' is shown in FIG. 15 to be received in the groove 87 of the involute 81. Seal 89' includes a seal body 211 which fits loosely in the tip groove 87. A groove 213 is formed in the seal body and receives a soft cord 215 which would be analogous to an O-ring. The cord 215 provides a soft seat between the seal body 211 and the involute tip groove 87 and creates a positive seal against leakage.

The seal body may be made of a material such as Teflon. Prior tip seals were made of Teflon based materials and were pushed against the side of the tip seal groove by the differential pressure across the seal. The contact between the tip seal and the seal groove formed a seal area to prevent leakage of higher pressure gasses into lower pressure gas packets. However, if the surface finish on the tip seal or seal groove was not smooth, gas would leak from the high pressure areas to the low pressure areas and reduce compressor performance. The use of the seal cord 215, which contacts the wall 217 of the tip groove 87, creates a positive seal, as noted above, to prevent any such leakage.

Variations within the scope of the appended claims may be apparent to those skilled in the art. For example, any number of idler crank assemblies can be provided. They do not need to be evenly spaced around the scroll members. These examples are merely illustrative.

I claim:

1. A scroll compressor comprising:

a motor housed in a motor shell and having a motor shaft extending axially from said motor shell;

a compressor housing secured to said motor shell, said housing having a circumferential side wall and a bottom, said bottom defining a boss; said motor shaft being rotatably journaled in said boss and extending through said boss into said housing;

an eccentric mounted on said motor shaft within said housing for rotation with said shaft;

an orbiting scroll member mounted on said eccentric to be orbitally driven by said motor shaft when said motor shaft rotates, said scroll including a plate having an inboard surface and an outboard surface and an involute extending from said inboard surface; said plate being mounted to said eccentric;

a fixed scroll secured to said housing, said fixed scroll including a plate having an inboard surface and an outboard surface and defining an inlet and an outlet and an involute extending from said inboard surface of said fixed scroll plate; said fixed scroll involute meshing with said orbiting scroll involute to define suction zones at outer ends of the involutes and fluid pockets; said fluid pockets being reduced in size as said scroll compressor is operated to compress a fluid;

at least two idler crank assemblies, each idler crank assembly extending between said fixed and orbiting scrolls and a seal for providing a seal between a tip of one involute and the plate of its opposing scroll member; at least one of said fixed scroll involute and said orbiting scroll involute having a groove in a tip thereof; said seal including a seal body which is received in said involute tip groove, said seal body defining a second groove facing a wall of said involute tip groove, and a compliant cord being received in said second groove, said cord contacting said wall of said involute tip groove to create a positive seal.

2. The scroll compressor of claim 1 wherein said tip groove is defined by a wall and said tip groove defines a depth, said tip groove wall having a width 25% or less than the depth of said tip groove.

3. The scroll compressor of claim 1 wherein said seal is placed in said fixed scroll involute and said orbiting scroll involute.

* * * * *

UNITED STATES PATENT AND TRADEMARK OFFICE

CERTIFICATE OF CORRECTION

PATENT NO. : 5,632,612

DATED : MAY 27, 1997

INVENTOR(S) : ROBERT SHAFFER

It is certified that error appears in the above-indentified patent and that said Letters Patent is hereby corrected as shown below:

On title page, item [73] change name of Assignee"Puritan-Beckkett, Corp." to ---Puritan-Bennett Corp.---.

Signed and Sealed this

Ninth Day of September, 1997

*Attest:*

*Attesting Officer*

BRUCE LEHMAN

*Commissioner of Patents and Trademarks*